US008080283B2

(12) United States Patent
Schlichting et al.

(10) Patent No.: US 8,080,283 B2
(45) Date of Patent: Dec. 20, 2011

(54) METHOD FOR FORMING A YTTRIA-STABILIZED ZIRCONIA COATING WITH A MOLTEN SILICATE RESISTANT OUTER LAYER

(75) Inventors: Kevin W. Schlichting, South Glastonbury, CT (US); Michael J. Maloney, Marlborough, CT (US); David A. Litton, West Hartford, CT (US); Melvin Freling, West Hartford, CT (US); John G. Smeggil, Simsbury, CT (US); David B. Snow, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 12/760,836

(22) Filed: Apr. 15, 2010

(65) Prior Publication Data

US 2010/0196605 A1 Aug. 5, 2010

Related U.S. Application Data

(62) Division of application No. 11/336,572, filed on Jan. 20, 2006, now Pat. No. 7,736,759.

(51) Int. Cl.
*C23C 16/40* (2006.01)

(52) U.S. Cl. ..... 427/255.31; 427/255.34; 427/255.36; 427/255.7; 427/294

(58) Field of Classification Search ..... 427/255.36, 427/255.29, 250, 255.7, 294, 255.31, 255.34
See application file for complete search history.

(56) References Cited

U.S. PATENT DOCUMENTS

| | | | | |
|---|---|---|---|---|
| 6,077,344 | A * | 6/2000 | Shoup et al. | 117/9 |
| 6,177,200 | B1 * | 1/2001 | Maloney | 428/472 |
| 6,256,984 | B1 * | 7/2001 | Voss et al. | 60/299 |
| 6,399,154 | B1 * | 6/2002 | Williams et al. | 427/327 |
| 6,730,422 | B2 | 5/2004 | Litton et al. | |
| 6,875,529 | B1 | 4/2005 | Spitsberg et al. | |
| 6,969,558 | B2 * | 11/2005 | Walston et al. | 428/632 |
| 7,291,408 | B2 | 11/2007 | Litton et al. | |
| 7,326,470 | B2 | 2/2008 | Ulion et al. | |
| 2004/0038085 | A1 | 2/2004 | Litton et al. | |
| 2004/0038086 | A1 | 2/2004 | Litton et al. | |
| 2005/0129849 | A1 * | 6/2005 | Ackerman et al. | 427/252 |
| 2005/0244663 | A1 | 11/2005 | Ulion et al. | |

FOREIGN PATENT DOCUMENTS

| | | | |
|---|---|---|---|
| EP | 0992603 | A | 4/2000 |
| EP | 1321542 | A | 6/2003 |
| EP | 1327704 | A | 7/2003 |
| EP | 1400611 | A | 3/2004 |
| EP | 1591550 | A | 11/2005 |
| EP | 1806432 | A | 7/2007 |

OTHER PUBLICATIONS

Tsoga, A., et al., "Gadolinia-doped Ceria and Yttria Stabilized Zirconia Interfaces: Regarding their application for SOFC technology". Acta mater. 48 (2000) pp. 4709-4714.*

Gnanarajan, S., et al., "Biaxially aligned buffer layers of cerium oxide, yttria stabilized zirconia, and their bilayers." Appl. Phys. Lett. 70 (21), May 26, 1997, pp. 2816-2818.*

Hwang, Hae Jin, et al., "Fabrication of Lanthanum Manganese Oxide Thin Films on Yttria-Stabilized Zirconia Substrates by a Chemically Modified Alkoxide Method". J. Am. Ceram. Soc., 84 (10) pp. 2323-2327 (2001).*

* cited by examiner

*Primary Examiner* — Bret Chen
(74) *Attorney, Agent, or Firm* — Bachman & LaPointe, P.C.

(57) ABSTRACT

A method for providing a component with protection against sand related distress includes the steps of: providing a substrate; depositing a layer of a yttria-stabilized zirconia material on the substrate; and forming a molten silicate resistant outer layer over the yttria-stabilized zirconia material.

17 Claims, 3 Drawing Sheets

METHOD FOR FORMING A YTTRIA-STABILIZED ZIRCONIA COATING WITH A MOLTEN SILICATE RESISTANT OUTER LAYER

CROSS REFERENCE TO RELATED APPLICATION(S)

This application is a divisional application of allowed U.S. patent application Ser. No. 11/336,572, filed Jan. 20, 2006, entitled YTTRIA-STABILIZED ZIRCONIA COATING WITH A MOLTEN SILICATE RESISTANT OUTER LAYER, now U.S. Pat. No. 7,736,759.

BACKGROUND OF THE INVENTION (1) Field of the Invention

The present invention relates to a yttria-stabilized zirconia coating with a molten silicate resistant outer layer which can be applied to a turbine engine component, to a method for forming the coating, and to a turbine engine component having the coating.

(2) Prior Art

The degradation of turbine airfoils due to sand related distress of thermal barrier coatings is a significant concern with all turbine engines used in a desert environment. This type of distress can cause engines to be taken out of operation for significant repairs.

Sand related distress is caused by the penetration of fluid sand deposits into the thermal barrier coatings which leads to spallation and accelerated oxidation of any exposed metal.

SUMMARY OF THE INVENTION

In accordance with the present invention, there is provided a coating system which reduces sand related distress on turbine engine components. The coating system broadly comprises a layer of yttria-stabilized zirconia and a molten silicate resistant outer layer.

Further in accordance with the present invention, a turbine engine component is provided which broadly comprises a substrate, which may or may not include a metallic bondcoat, a yttria-stabilized zirconia coating applied over the substrate, and a molten silicate resistant outer layer. The molten silicate resistant outer layer may be formed from an oxide selected from the group consisting of lanthanum, cerium, praseodymium, neodymium, promethium, samarium, europium, gadolinium, terbium, dysprosium, holmium, erbium, thulium, ytterbium, lutetium, scandium, indium, zirconium, hafnium, titanium, and mixtures thereof, or from gadolinia-stabilized zirconia. Alternatively, the molten silicate resistant outer layer may be a zirconia, hafnia, or titania based coating with at least one oxide selected from the group consisting of lanthanum, cerium, praseodymium, neodymium, promethium, samarium, europium, gadolinium, terbium, dysprosium, holmium, erbium, thulium, ytterbium, lutetium, scandium, and indium as a stabilizing element.

Still further in accordance with the present invention, a method for forming a coating system which reduces sand related distress is provided. The method broadly comprises the steps of providing a substrate, depositing a layer of a yttria-stabilized zirconia material on the substrate, and forming a molten silicate resistant outer layer over the yttria-stabilized zirconia material.

Other details of the yttria-stabilized zirconia coating with a molten silicate resistant outer layer of the present invention, as well as other objects and advantages attendant thereto, are set forth in the following detailed description and the accompanying drawing wherein like reference numerals depict like elements.

DETAILED DESCRIPTION OF THE PREFERRED EMBODIMENT(S)

It has been discovered that certain coatings react with fluid sand deposits and a reaction product forms that inhibits fluid sand penetration into the coating. The reaction product has been identified as being a silicate oxyapatite/garnet containing primarily gadolinia, calcia, zirconia, and silica. The present invention relates to a coating system for a component, such as a turbine engine component, which takes advantage of this discovery.

Figure 1:
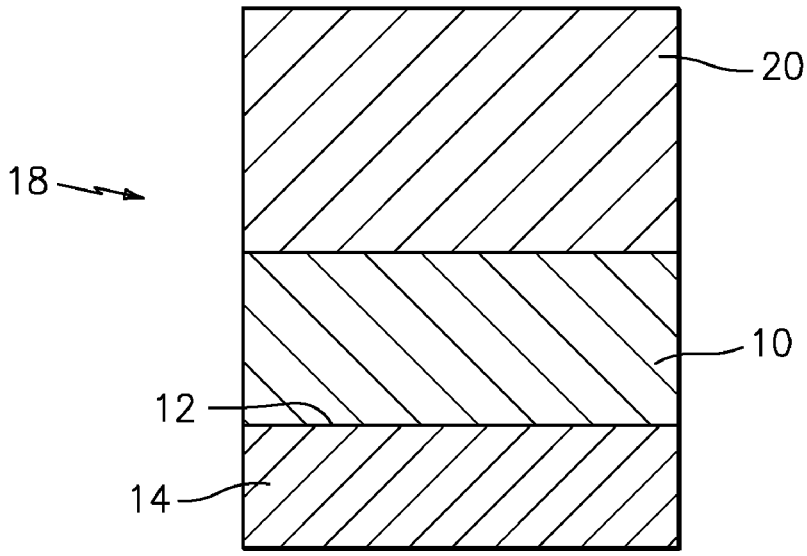
FIG. 1 is a schematic representation of a turbine engine component with the coating of the present invention.
Figure 4:
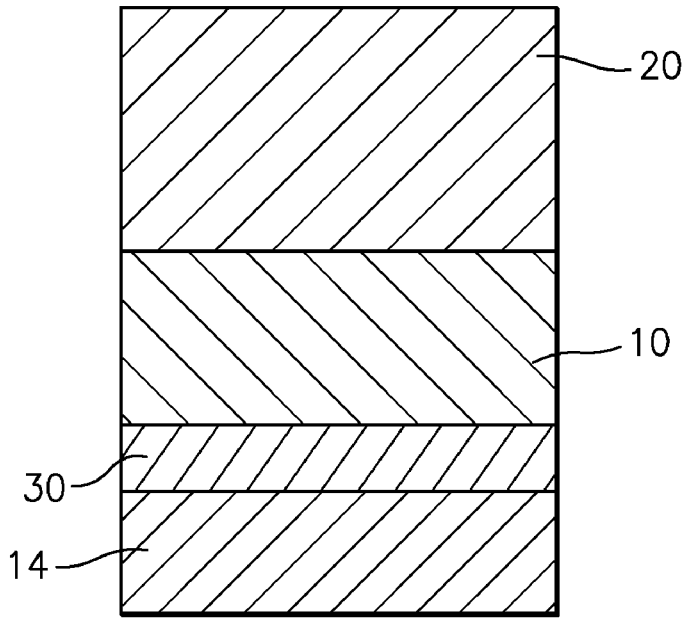
FIG. 4 is a schematic representation of a turbine engine component with an alternative embodiment of a coating in accordance with the present invention.

In accordance with the present invention, referring now to FIG. 1, the coating system 18 of the present invention includes a yttria-stabilized zirconia thermal barrier coating 10 applied to a surface 12 of a substrate 14, such as a turbine engine component including, but not limited to, a blade or a vane. The substrate 14 may be formed from any suitable material such as a nickel based superalloy, a cobalt based alloy, a molybdenum based alloy or a titanium alloy. The substrate 14 may or may not be coated with a metallic bondcoat 30 (as shown in FIG. 4). Suitable metallic bondcoats 30 which may be used include diffusion bondcoats, such as platinum-aluminide coating or an aluminide coating, or MCrAlY coatings where M is at least one of nickel, cobalt, and iron. The bondcoat 30 may have any desired thickness.

The yttria-stabilized zirconia thermal barrier coating 10 may be applied by, for example, electron beam physical vapor deposition (EB-PVD) or air plasma spray. Other methods which can be used to deposit the yttria stabilized zirconia thermal barrier coating 10 includes, but is not limited to, sol-gel techniques, slurry techniques, sputtering techniques, and chemical vapor deposition techniques.

A preferred process for performing the deposition of the yttria-stabilized zirconia thermal barrier coating 10 is EB-PVD. When performing this process, the substrate 14 is placed in a coating chamber and heated to a temperature in the range of from 1700 to 2000 degrees Fahrenheit. The coating chamber is maintained at a pressure in the range of from 0.1 to 1.0 millitorr. The feedstock feed rate is from 0.2 to 1.5 inches/hour. The coating time may be in the range of from 20 to 120 minutes.

The deposited coating 10 may have a thickness of from 3.0 to 50 mils, preferably from 5.0 to 15 mils. The deposited coating 10 may have a yttria content in the range of from 4.0 to 25 wt %, preferably from 6.0 to 9.0 wt %. The deposited coating 10 may consist of yttria in the amount of 4.0 to 25 wt % and the balance zirconia. In a more preferred embodiment, the deposited coating 10 may consist of yttria in the amount of 6.0 to 9.0 wt % yttria and the balance zirconia.

After the yttria-stabilized coating 10 has been deposited, a molten silicate resistant outer layer 20 is formed over the coating 10. The outer layer 20 may be formed from an oxide selected from the group consisting of lanthanum, cerium, praseodymium, neodymium, promethium, samarium, europium, gadolinium, terbium, dysprosium, holmium, erbium, thulium, ytterbium, lutetium, scandium, indium, zirconium, hafnium, titanium, and mixtures thereof. Alternatively, the outer layer 20 may be a gadolinia stabilized zirconia. In yet another alternative, the molten silicate resistant outer layer 20 may be a zirconia, hafnia, or titania based coating with at least one oxide selected from the group consisting of lanthanum, cerium, praseodymium, neodymium, promethium, samarium, europium, gadolinium, terbium, dysprosium, holmium, erbium, thulium, ytterbium, lutetium, scandium, and indium as a stabilizing element.

The material(s) forming the outer layer 30 may be deposited using any of the deposition techniques mentioned hereinbefore. When the outer layer 20 is formed from a gadolinia stabilized zirconia, the outer layer may contain from 25 to 99.9 wt % gadolinia and may have a thickness in the range of from 1.0 to 50 mils. In a preferred embodiment, gadolinia is present in an amount from 40 to 70 wt % and/or the layer 20 has a thickness in the range of from 1.0 to 15 mils. If desired, the outer layer 20 may be formed from a material consisting of from 25 to 99.9 wt % gadolinia and the balance zirconia. Still further, if desired, the outer layer 20 may be formed from a material consisting of from 40 to 70 wt % gadolinia and the balance zirconia.

The two layer coating system of the present invention may not have a defined interface between the two layers 10 and 20. Rather, the two layers 10 and 20 may blend together to form a gradient from yttria-stabilized zirconia rich to gadolinia stabilized rich.

The outer layer 20 of the present invention will react with molten sand deposits and form a barrier phase of oxyapatite and/or garnet to resist further penetration. The gadolinia layer 20 will have sufficient thickness to form the desired barrier phase.

Figure 2A:
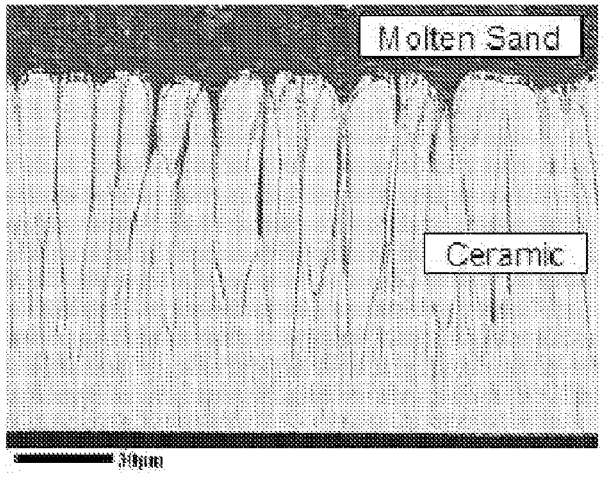
FIGS. 2A-2C are photomicrographs illustrating the penetration of molten silicate material into a conventional thermal barrier coating.
Figure 2B:
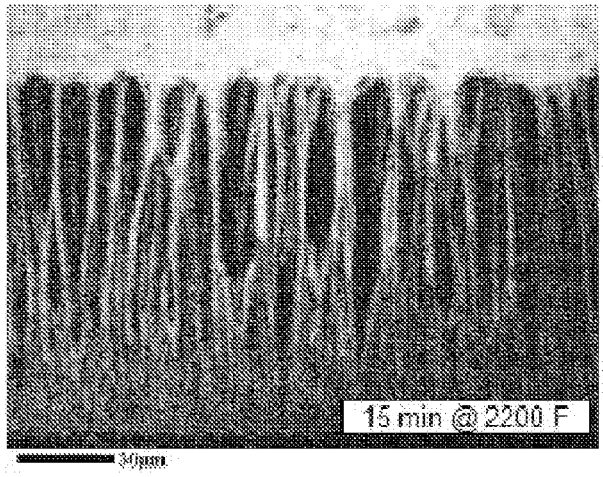
Figure 2C:
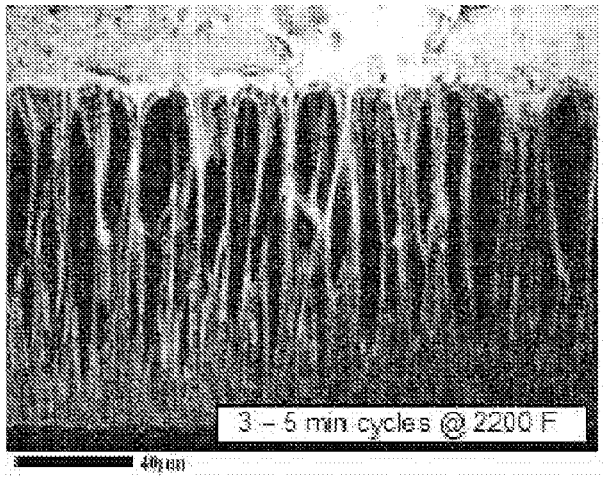
Figure 3A:
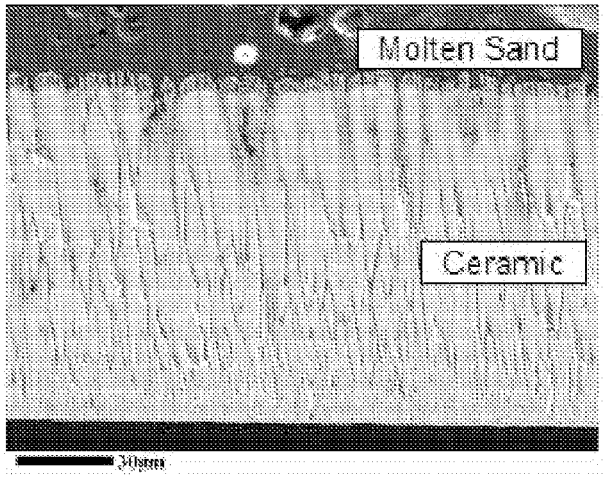
FIGS. 3A-3C are photomicrographs illustrating the penetration of molten silicate material into a thermal barrier coating in accordance with the present invention.
Figure 3B:
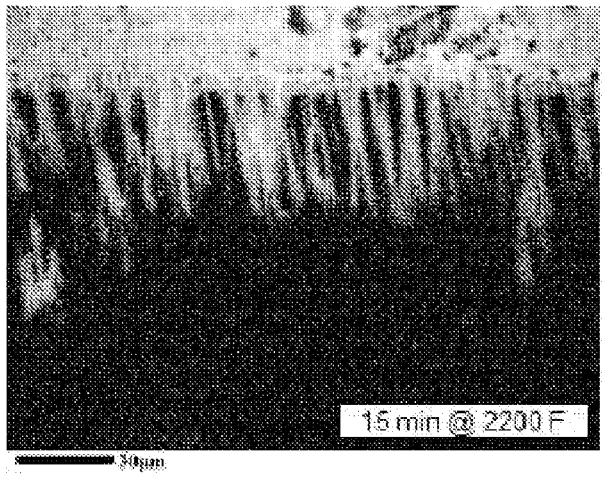
Figure 3C:
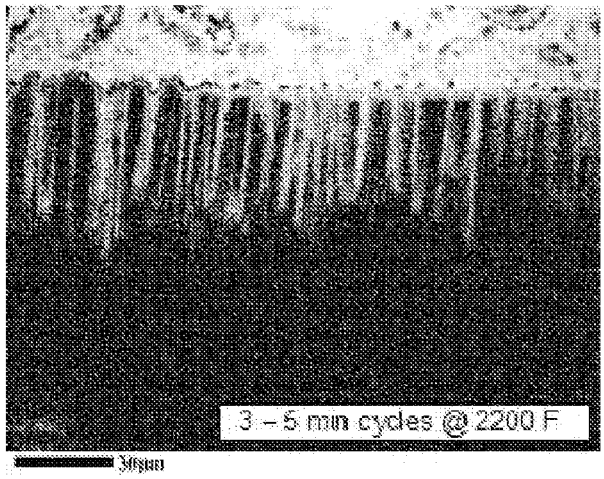

FIGS. 2A-2C illustrate the penetration of molten silicate material into a thermal barrier coating having a single layer of 7 wt % yttria-stabilized zirconia. FIG. 2B illustrates the penetration after a 15 minute exposure at 2200 degrees Fahrenheit. FIG. 2C shows the penetration after three 5 minute cycles at a temperature of 2200 degrees Fahrenheit. FIGS. 3A-3C illustrate the penetration of molten silicate material into a thermal barrier coating system having a 59 wt % gadolinia-stabilized zirconia. FIG. 3B illustrates the penetration after a 15 minute exposure at 2200 degrees Fahrenheit. FIG. 3C illustrates the penetration after three 5 minute cycles at a temperature of 2200 degrees Fahrenheit. The reduced penetration which is obtained with an outer layer of 59 wt % gadolinia stabilized zirconia in accordance with the present invention is readily apparent.

The coating of the present invention is an advantageous thermal barrier coating system that resists the penetration of molten silicate material. The coating system provides enhanced durability in environments where sand induced distress of turbine airfoils occurs.

It is apparent that there has been provided in accordance with the present invention a yttria-stabilized zirconia coating with a molten silicate resistant outer layer which fully satisfies the objects, means, and advantages set forth hereinbefore. While the present invention has been described in the context of specific embodiments, other unforeseeable alternatives, modifications, and variations may become apparent to those skilled in the art having read the foregoing description. Accordingly, it is intended to embrace those alternatives, modifications, and variations which fall within the broad scope of the appended claims.

What is claimed is:

1. A method for providing a component with protection against sand related distress comprising the steps of:

providing a substrate;

depositing a layer of a yttria-stabilized zirconia material on the substrate; and forming a molten silicate resistant outer layer over the yttria-stabilized zirconia material, wherein said molten silicate resistant outer layer forming step comprises depositing a layer of an oxide selected from the group consisting of lanthanum, cerium, praseodymium, neodymium, promethium, samarium, europium, terbium, dysprosium, holmium, erbium, thulium, ytterbium, lutetium, scandium, indium, hafnium, titanium, and mixtures thereof over the yttria-stabilized zirconia material.

2. The method according to claim 1, further comprising applying a metallic bondcoat to said substrate.

3. The method according to claim 2, wherein said metallic bondcoat applying step comprises applying a metallic bondcoat selected from the group consisting of a platinum-aluminide coating and an aluminide coating.

4. The method according to claim 1, wherein said yttria-stabilized zirconia coating depositing step comprises depositing a material containing from 4.0 to 25 wt % yttria.

5. The method according to claim 1, wherein said yttria-stabilized zirconia coating depositing step comprises depositing a material containing from 6.0 to 9.0 wt % yttria.

6. The method according to claim 1, wherein said yttria-stabilized zirconia coating depositing step comprises depositing a material consisting of from 4.0 to 25 wt % yttria and the balance zirconia.

7. The method according to claim 1, wherein said yttria-stabilized zirconia coating depositing step comprises depositing a material containing from 6.0 to 9.0 wt % yttria and the balance zirconia.

8. The method according to claim 1, wherein said yttria-stabilized zirconia coating depositing step comprises forming a coating having a thickness in the range of from 3.0 to 50 mils.

9. The method according to claim 1, wherein said yttria-stabilized zirconia coating depositing step comprises forming a coating having a thickness in the range of from 5.0 to 15 mils.

10. The method according to claim 1, wherein said substrate providing step comprises providing a substrate formed from a nickel based alloy.

11. The method according to claim 1, further comprising:

placing said substrate into a coating chamber;

heating said substrate in said coating chamber to a temperature in the range of from 1700 to 2000° F.;

maintaining pressure in said coating chamber at a pressure in the range of from 0.1 to 1.0 millitorr; and sequentially forming said yttria-stabilized zirconia layer and said molten silicate resistant outer layer.

12. A method for providing a component with protection against sand related distress comprising the steps of:

providing a substrate;

depositing a layer of a yttria-stabilized zirconia material on the substrate; and forming a molten silicate resistant outer layer over the yttria-stabilized zirconia material, wherein said molten silicate resistant outer layer forming step comprises depositing a layer consisting of gadolinia stabilized zirconia over the yttria-stabilized zirconia material.

13. The method according to claim 12, wherein said gadolinia stabilized zirconia depositing step comprises depositing a material consisting of from 25 to 99.9 wt % gadolinia and the balance zirconia.

14. The method according to claim 12, wherein said gadolinia stabilized zirconia depositing step comprises depositing a material consisting of from 40 to 70 wt % gadolinia and the balance zirconia.

15. The method according to claim 12, wherein said molten silicate resistant outer layer forming step comprises depositing a layer of said gadolinia stabilized zirconia having a thickness in the range of from 1.0 to 50 mils over the yttria-stabilized zirconia material.

16. The method according to claim 12, wherein said molten silicate resistant outer layer forming step comprises depositing a layer of said gadolinia stabilized zirconia having a thickness in the range of from 1.0 to 15 mils over the yttria-stabilized zirconia material.

17. A method for providing a component with protection against sand related distress comprising the steps of:

providing a substrate;

depositing a layer of a yttria-stabilized zirconia material on the substrate; and forming a molten silicate resistant outer layer over the yttria-stabilized zirconia material, wherein said molten silicate resistant outer layer forming step comprises depositing a layer consisting of a first constituent selected from the group consisting of hafnia and titania and a stabilizing element comprising at least one oxide selected from the group consisting of lanthanum, cerium, praseodymium, neodymium, promethium, samarium, europium, gadolinium, terbium, dysprosium, holmium, erbium, thulium, ytterbium, lutetium, scandium, and indium.

* * * * *